United States Patent [19]

Caron

[11] 4,405,067

[45] Sep. 20, 1983

[54] AMPOULE OPENER

[76] Inventor: Peter L. Caron, 342 Washington St., Arlington, Mass. 02174

[21] Appl. No.: 277,145

[22] Filed: Jun. 25, 1981

[51] Int. Cl.[3] ..... B26F 3/00

[52] U.S. Cl. ..... 225/93; 241/99

[58] Field of Search ..... 225/1, 93, 96.5; 241/99; 81/3 R

[56] References Cited

U.S. PATENT DOCUMENTS

| | | | |
|---|---|---|---|
| 2,488,956 | 11/1949 | Yeskett | 225/96.5 |
| 2,515,020 | 7/1950 | Scott | 225/96.5 X |
| 3,450,319 | 6/1969 | Ray et al. | 241/99 X |
| 3,692,220 | 9/1972 | Seng | 225/96.5 |
| 4,226,376 | 10/1980 | Pfleger | 225/93 X |
| 4,269,364 | 5/1981 | Moriconi et al. | 241/99 X |

FOREIGN PATENT DOCUMENTS

| | | | |
|---|---|---|---|
| 593263 | 5/1925 | France | 225/93 |

*Primary Examiner*—Frank T. Yost
*Attorney, Agent, or Firm*—Charles E. Pfund

[57] ABSTRACT

An ampoule opener for safely and conveniently breaking the tips off elongated ampoules of varying sizes to make possible the extraction of the contents therefrom. The opener includes a housing having an opening formed on the front face thereof for insertion of an ampoule tip therethrough. A projection extending outwardly from the front face is disposed adjacent a lower edge of the opening and serves as a fulcrum upon which the ampoule neck is placed and about which torque is applied to snap off the ampoule tip at the neck when the end of the tip engages an internal bearing surface. A hood over the housing opening protects the user from any spray resulting from the breaking of the ampoule and an internal cavity collects the tips broken from the ampoules.

6 Claims, 8 Drawing Figures

AMPOULE OPENER

FIELD OF THE INVENTION

This invention relates generally to devices for opening frangible containers and more particularly, to devices for safely and conveniently opening ampoules of varying sizes by breaking off the tips of the ampoules.

BACKGROUND OF THE INVENTION

Ampoules are frequently used in medicine and in science for the contamination free provision of precisely measured quantities of fluids. The fluids themselves have a variety of uses. The ampoules are generally opened by being broken at a circumferential groove etched in the surface of the glass or at a neck of reduced diameter. Since the ampoules are generally formed of glass, there is a danger that, if a safe breaking means is not available, the break will not be clean and that the user will be cut by a jagged edge. In addition, pieces of glass may fall into the fluid within the ampoule, thereby contaminating it, and occasionally, some of the fluid within the ampoule will splash onto the user during the opening process. In hospitals, the ampoules frequently are opened in stressful situations by snapping the top with the hands. Accidents such as those described above are common in such situations.

Many devices are currently available for assisting in the opening of ampoules, but most of them do not provide the user sufficient protection from the above hazards, and they normally are each suited for only a specific size and shape of ampoule. Some ampoule breaking devices must be hand held and do not collect the broken tips. Further, they often provide the user with no protection from splashed fluids or broken glass. Examples of ampoule breakers of this type are found in U.S. Pat. Nos. 3,450,319; 2,503,517; 2,515,020; and 2,638,022. Other ampoule breakers are adapted for mounting on a wall, but still do not provide any means for collecting the broken ampoule tips. Such devices are shown in U.S. Pat. Nos. 2,425,093 and 2,359,644. Still other ampoule breakers have means for collecting the broken tips of the ampoules, but are not suited for a wide range of ampoule sizes, and require means for scoring the ampoule to facilitate breaking thereof.. Examples of such devices are shown in U.S. Pat. Nos. 3,692,220; 2,488,956 and 2,655,767.

SUMMARY OF THE INVENTION

Broadly speaking, this invention concerns a device for opening frangible containers of varying sizes and shapes, and more particularly concerns an ampoule opener for snapping off the tips of any size elongated ampoule cleanly and at the proper attitude, without contamination or loss of the contents and without injury to the user.

This invention includes a housing having an upper opening on a front wall thereof for insertion of the ampoule tip therethrough. This front wall typically has a vertical orientation during use of the opener and the size of the opening is sufficiently large to accommodate the largest diameter ampoule with which the device is to be used. Disposed just below the opening is a projection extending outwardly from the front wall. This projection provides a bearing surface against which the ampoule neck, between the ampoule body and top, is pressed and pivoted during the breaking operation. Within the housing of the device is an upper bearing surface which is slightly above and behind the opening. This upper bearing surface slopes downwardly toward the front wall, and is adapted to engage the top of the ampoule tip after it has been inserted through the opening to hold it in place when torque is applied to the ampoule body. The downward slope of the bearing surface permits breaking of ampoules of varying lengths and insures that, regardless of length, the ampoule is disposed at a non-horizontal angle when broken so tht no spillage or splattering of the contents occurs. In addition, the ampoule is tilted sufficiently with respect to the vertical so that no shattered glass pieces fall into the interior of the ampoule body.

Disposed below the opening within the housing is a container for collecting the broken ampoule tips. This container may be provided with means for disposing of the ampoule tips, or the entire device itself may be disposable. Located just above the opening is a hood which projects outwardly from the front wall sufficiently to protect the user from any splash or spray of liquid which might possibly result from breaking the ampoule. A plurality of other openings of varying sizes may be provided along the housing. These openings are configured to accept an ampoule tip of a predetermined diameter, so that the ampoule may be broken at the appropriate location and the tip may be collected as previously described.

The ampoule breaker of this invention may be permanently installed on a horizontal or vertical surface such as a wall or a unit of hospital or laboratory equipment, or it may be used while hand held. However it is employed, this invention permits the fast and safe opening of ampoules without fear of being cut by the glass or having the contents thereof splashed on the user. In addition, the broken tips are collected and readily disposed of without littering the work area.

DESCRIPTION OF THE DRAWING

The objects, advantages and features of this invention will be more clearly appreciated from the following detailed description when taken in conjunction with the accompanying drawing in which.

DETAILED DESCRIPTION OF THE PREFERRED EMBODIMENT

Figure 1:
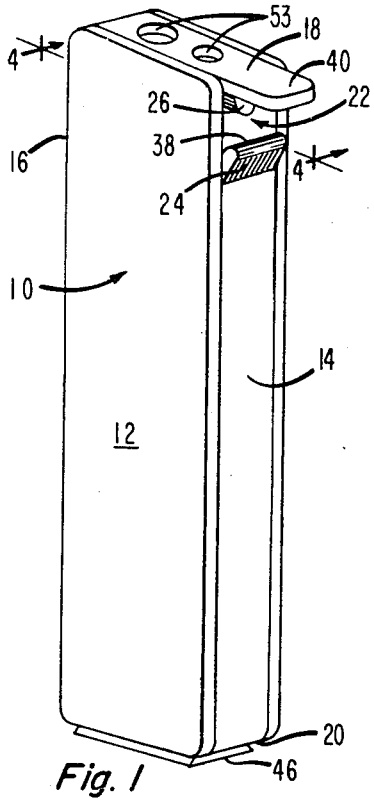
FIG. 1 is a perspective view of one embodiment of this invention.
Figure 2:
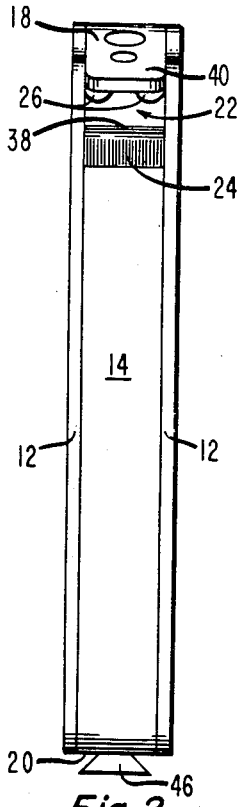
FIG. 2 is an elevational view of one narrow side of the embodiment of FIG. 1.

With reference to the drawing and more particularly to FIGS. 1–4, thereof, there is shown one embodiment of the ampoule opening device of this invention. The device includes a housing 10 formed of two sidewalls 12, a front wall 14, a rear wall 16, a top wall 18 and a bottom wall 20. Provided on front wall 14, typically at the upper end thereof adjacent top wall 18, is an opening 22 which is sufficiently large to accommodate the largest diameter ampoule 30 (FIG. 4) commonly used in a laboratory or hospital environment. It should be noted that opening 22 may be an actual opening in the front wall or it may be provided by a gap between the front and top walls, as shown in these figures. Positioned below opening 22 and adjacent thereto on front wall 14 is a projection 24 extending outwardly from front wall 14. An interior surface 21 of top wall 18 forms an acute angle with respect to rear wall 16 and an obtuse angle with respect to front wall 14 so that surface 21 slopes downwardly from back to front. Optionally disposed on surface 21 of the top wall within the housing cavity are a pair of parallel, spaced shoulders 26, as shown in FIGS. 1 and 2, extending from rear wall 16 toward front wall 14. A hood 40 extends outwardly from front wall 14 adjacent opening 22 to overlie the opening and projection 24.

Surface 21 serves as a bearing surface against which the ampoule tip 32 is pressed during the breaking operation, while shoulders 26 facilitate alignment of the ampoule tip to prevent lateral or angular movement thereof during the breaking operation. Surface 21 typically extends a distance between walls 14 and 16 generally equal to the length of the longest ampoule tip 32 with which this device is adapted to be employed. Projection 24 serves as a fulcrum about which an ampoule 30 to be broken is pivoted at its neck 34. In the embodiment of FIGS. 1–4, projection 24 forms the lower boundary of opening 22, but the projection may be spaced from the lower edge of opening 22, as will be described. Projection 24 should extend outwardly from front wall 14 sufficiently far to permit a user to grasp an ampoule body and exert a downward force thereon without his fingers striking front wall 14 or having the front wall otherwise interfere with the application of torque to the ampoule body 36. The upper edge 38 of projection 24, which serves as the fulcrum point, should be rounded to accommodate the rounded neck 34 of a typical ampoule 30. While opening 22 is shown in FIG. 1 to be rectangular, it may have any other desired shape as long as it will accommodate insertion of the tip 32 of an ampoule 30. Opening 22 should be large enough to accept any size ampoule tip 32, but it need not be sufficiently large to permit the ampoule body 36 to be inserted therethrough. Hood 40, which extends over projection 24, serves as a shield to prevent any fluids in the ampoule from splashing up and striking the user. In this embodiment, hood 40 is formed as an extension of top wall 18, although it need not be.

Regardless of the ampoule size, it is important when opening such containers that the body 36 be in a non-horizontal position, that is, the neck should be somewhat above the body, and that the body be in a more nearly vertical position at the termination of the breaking operation so that the contents of the ampoule are not lost. In addition, the ampoule should not be vertically oriented during the breaking operation so that ampoule glass around the break will not tend to fall into the interior of the ampoule. In order to accomplish this result for any size ampoule presently available for hospital or laboratory use, surface 21 is provided with a downward slope toward front wall 14, and projection 24 is spaced an appropriate distance from surface 21. For longer ampoules, tip 32 bears against surface 21 near rear wall 16 while for shorter ampoules the tip 32 bears against surface 21 much closer to opening 22. In both cases, the sloped surface 21 and the spacing of projection 24 therefrom insures that the ampoule will be in an appropriate angular position between the horizontal and the vertical while being opened. The precise slope of surface 21 is a function of the desired maximum and minimum length of ampoules to be utilized, and typically, a slope of about 6° provides the desired performance.

Figure 3:
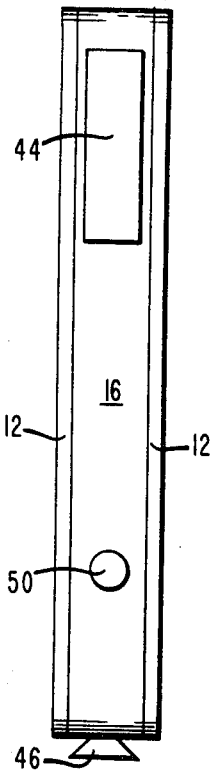
FIG. 3 is an elevational view of the opposite narrow side of the embodiment of FIG. 1.
Figure 4:
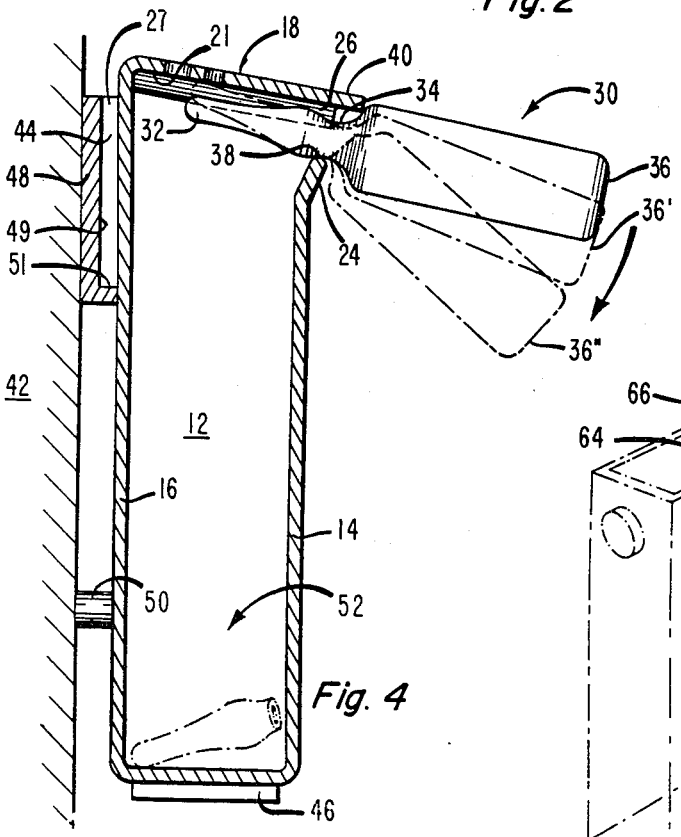
FIG. 4 is a cross-sectional view from another side of the embodiment of FIG. 1 showing the invention in use.

Means for mounting housing 10 of this invention on a suitable wall or bulkhead 42 may also be provided. In one configuration, as shown in FIGS. 2–4, the mounting means includes a projection 44 disposed on rear wall 16 or a projection 46 disposed on bottom wall 20 or both projections 44 and 46. Projections 44 and 46 are each provided with upwardly beveled edges which have a dovetail shape and which are adapted to be slid into an open end 27 and against a closed end 51 of mating dovetailed slots 49 of a mounting fixture 48. Fixture 48 typically is secured to bulkhead 42 or to a horizontal surface (not shown), depending upon the positions available to the user. Projection 44 mounts housing 10 to fixture 48 on a vertical surface such as bulkhead 42, while projection 46 mounts the housing to similar fixture on a horizontal surface. In order to provide stability to the housing when mounted to a vertical surface, a spacer 50 is provided adjacent the bottom end of rear wall 16. Spacer 50 projects outwardly from the rear wall a distance equal to the thickness of fixture 48, so that the housing is maintained in a generally vertical orientation and will not pivot during use. Projections 44 and 46 permit this device to be permanently mounted in one location or be moved from place to place as needed for use thereof, as long as corresponding mounting fixtures 48 are available. In addition, the housing may be hand held during use, if desired.

Figure 6:
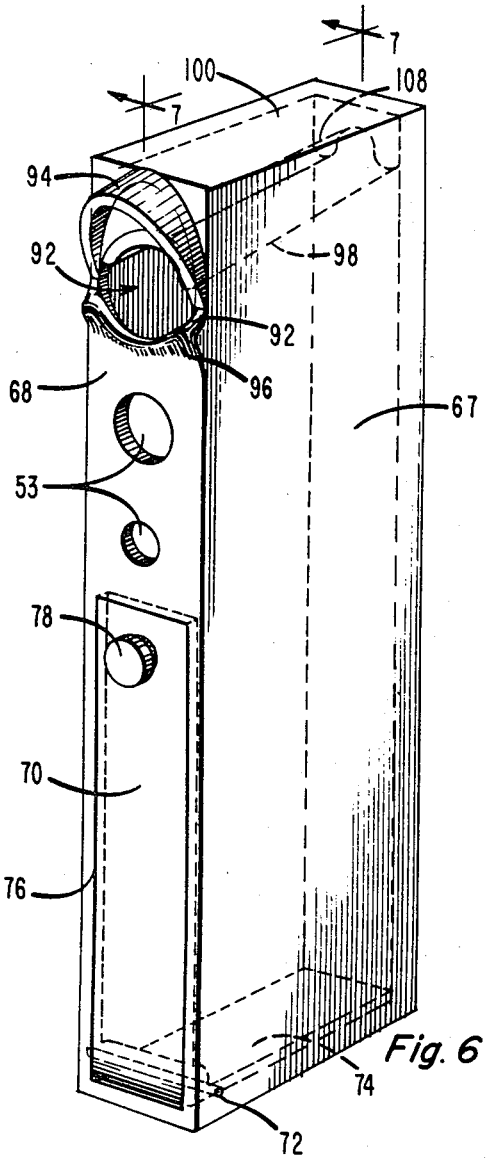
FIG. 6 is a perspective view of another embodiment of the device of this invention.

Secondary openings 3 may be provided in various walls of the housing 10 for use with very small ampoules or with ampoules having extended tips 32 which cannot be accommodated by the space between front wall 14 and rear wall 16. Typically, openings 53 are provided along top wall 18 as shown in FIG. 1 or along front wall 14, as shown in FIG. 6. When such secondary openings are utilized, the opening is selected which has a diameter as closely equal as possible to that of tip 32 of an ampoule, and the ampoule tip is inserted therein as far as possible for breaking thereof.

Figure 5:
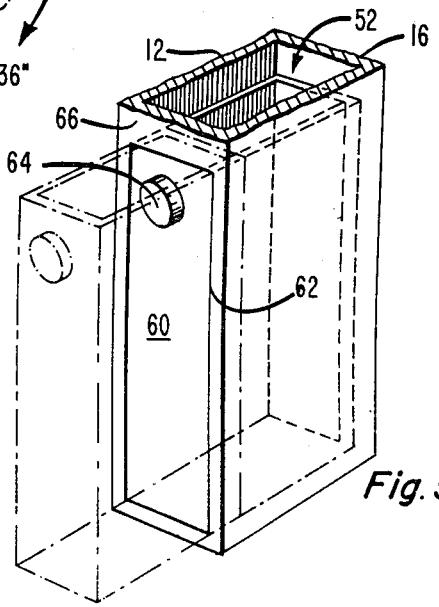
FIG. 5 is a partial perspective broken away view of another embodiment of the device of this invention.

In the embodiment of FIGS. 1–4, once an ampoule tip 32 is severed from its body 36 at neck 34, the tip falls into cavity 52 within the housing defined by sidewalls 12, front wall 14, rear wall 16 and bottom wall 20. Cavity 52 serves to collect the broken ampoule tips 32 and prevent them from littering the floor or in other ways creating a nuisance. Typically, when the cavity becomes filled with ampoule tips, the entire device is discarded, and a new ampoule opener is provided. However, if desired, means may be provided for disposing of the discarded ampoule tips without necessitating replacement of the device. Examples of such disposal means are shown in FIGS. 5–8, and may be incorporated into the embodiment of FIGS. 1–4 if desired. In the embodiment of FIG. 5, a drawer 60 is provided which slides in and out through an opening 62 in front wall 66. Drawer 60 includes a handle 64 to permit manual withdrawal thereof. The width of drawer 60 should be substantially equal to the distance between sidewalls 12 within cavity 52, while the depth of the drawer should be substantially equal to the distance between front wall 66 and rear wall 16 within the cavity in order to prevent any ampoule tips from sliding between the sidewalls of the drawer and the walls of the housing. In this manner, all ampoule tips deposited through opening 22 are collected by drawer 60, and the drawer may be emptied when filled and thereafter replaced.

Figure 7:
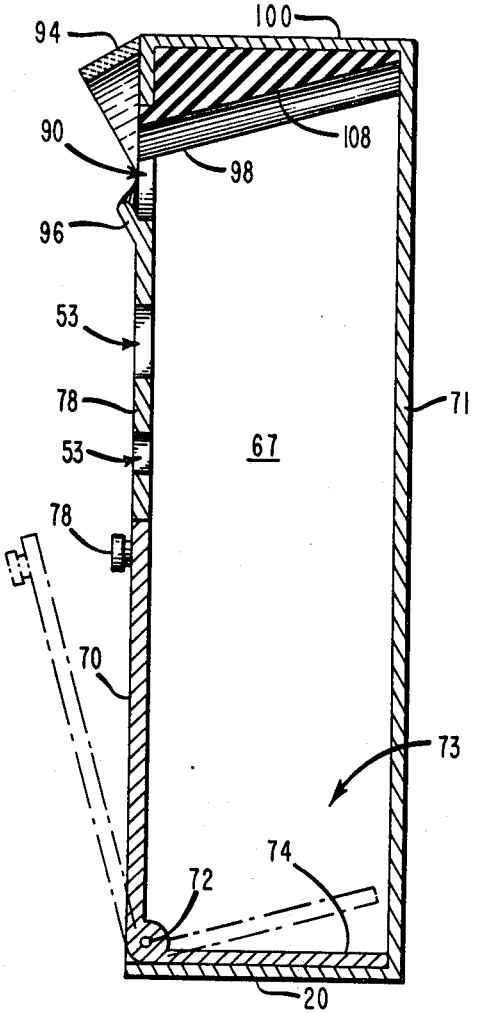
FIG. 7 is a cross-sectional side view of the device of FIG. 6.

As shown in FIGS. 6 and 7, another embodiment includes a tilting door 70 along front wall 68. Door 70 is typically pivotally mounted about a pin 72 disposed at a lower end thereof adjacent the junction of front wall 68 and bottom wall 20. Door 70 is also provided with a flap 74 which extends generally perpendicularly thereof so that the flap is generally parallel to bottom wall 20 when door 70 is closed. Flap 74 has substantially the same width as the distance between sidewalls 67 within cavity 73 and the same length as the distance between front wall 68 and rear wall 71 within cavity 73. Flap 74 pivots upwardly when door 70 is opened by pivoting downwardly, as shown by dotted lines in FIG. 7, to urge ampoule tips residing on flap 74 outwardly through opening 76 in the front wall. A handle 78 may be provided for the convenience of the user. Door 70 may have a width equal to the width of the front wall, or it may have a somewhat lesser width, as desired. In any event, door 70 forms the lower portion of the front wall in this embodiment.

Figure 8:
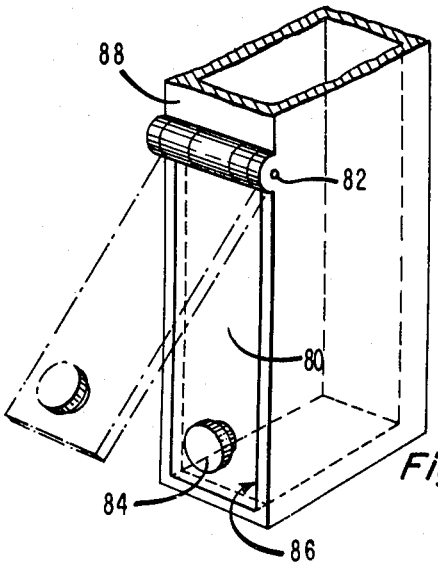
FIG. 8 is a partial perspective view of another embodiment of the device of this invention.

Another variation is shown in FIG. 8, in which a door 80 is pivotably mounted about a pin 82 disposed at an upper end thereof. A handle 84 is provided at the lower end of door 80 for easy opening, and the door may have the same width as front wall 88 or it may have a lesser width, as desired. In use, the door may be opened by grasping handle 84 and raising thereof, thereby allowing the ampoule tips to slide out through opening 86 in the front wall when the device is tilted forwardly.

FIGS. 6 and 7 also disclose another configuration of the ampoule opener of this invention. Instead of the square opening 22 of FIG. 1, a rounded opening 90 is provided, and hood 94 is also rounded to conform to the shape of the opening. Projection 96 is adjacent opening 90 and does not form the lower boundary thereof as in the embodiment of FIG. 1. Projection 96 may have a rounded configuration to conform to the shape of the opening, or it may extend straight across front wall 68. Top wall 100 is generally perpendicular with respect to each of sidewalls 67, front wall 68 and rear wall 71. A separate ramp 108 is provided on the interior surface of top wall 100 to provide the desired slope for the ampoule tip bearing surface. Ramp 108 typically is formed of a nonskid material, such as rubber, so as to prevent movement of the ampoule tip during the breaking operation. The ramp has the same slope from rear wall 71 to front wall 68 as inner surface 21 of top wall 18 of the device of FIG. 1. Shoulders 98 may be formed integrally with the ramp and the ramp may be curved upwardly between the crests of parallel shoulders 98 in a parabolic or semi-circular cross-sectional configuration. In all other respects, the embodiment of FIGS. 6 and 7 operates in a manner identical to the embodiment of FIGS. 1 through 4.

With reference now to FIG. 4, the operation of this invention will be described. The housing 10 may be hand held, or it may be permanently mounted to a horizontal or vertical surface in any conventional manner, or it may be temporarily mounted to a horizontal or vertical surface, as shown in FIG. 4. If temporarily mounted, dovetail projection 44 or 46 is slid into an open end 27 of mating slot 49 in fixture 48 which is secured to a vertical or a horizontal surface respectively. The dovetail projection is then slid into abutment with closed end 51. On a vertical surface such as surface 42, spacer 50 rests against that surface to provide the necessary stability for operation thereof. A tip 32 of an ampoule 30 is inserted through opening 22 until neck 34 rests on edge 38 of projection 24. Tip 32 is placed between spaced shoulders 26 which prevent undesired lateral movement of the tip during opening. The ampoule body 36 is then grasped by the user who exerts a slight downward force thereon. This force causes the ampoule body to pivot from the position shown by the solid lines 36 to that position shown by the first dashed lines 36'. In this position, the ampoule body 36' is not in a vertical position, so that any splintered glass from the ampoule neck or tip will not fall into the interior of body 36 during the subsequent breaking and opening thereof. The tip 32 is now in contact with surface 21. Continued downward pressure, preferably sharply or quickly, on ampoule body 36 causes a torque to be applied resulting in a breaking of the ampoule at neck 34. Because tip 32 is completely within housing 10 it, in effect, springs off surface 21 into cavity 52 where it is collected. The ampoule body is now tilted to the position shown by the lowermost dashed lines 36'' in FIG. 4. In this position, the ampoule body 36'' is approaching a more vertical orientation, so that none of the contents thereof are permitted to flow through the open neck 34 after severing of tip 32. However, as stated previously, the ampoule is still at a sufficient angle to prevent any particles of glass from entering the ampoule. Also, there is no interference between front wall 14 and the fingers or other parts of the hand of the person utilizing the device which could prevent the pivoting of body 36 about projection 24. Hood 40 prevents splashing of any of the ampoule contents which may be residing within neck 34 onto the user or about the area during the breaking operation.

When filled, housing 10 may be removed merely by raising the dovetail projection 44 out through open end 27 of retainer 48, and the housing may then be discarded. If it is desired to use the device in another location, the device may be removed from its mounting 48 and carried to another location where another mounting 48 is provided on a vertical wall or horizontal surface.

The dovetail mounting feature described herein is exemplary, and housing 10 may be affixed to a vertical or a horizontal surface in any other manner known to those skilled in the art. The housing is typically composed of a molded plastic material and may be formed in a unitary piece or in components which are assembled to form the structure. The housing preferably is formed of a transparent material such as polystyrene so that it can be easily determined when the cavity is filled with ampoule tips. However, any other suitable material may be employed for the housing, and it need not be transparent. Typically, all portions of the housing including the walls and projection 24 thereof are formed of the same material. If the embodiment of FIGS. 6 and 7 is employed, the ramp 108 is formed of a plastic such as polyethylene or a rubber material such as neoprene, both having compression measurement of 55 durometers.

For reference purposes only, examples of the dimensions of an ampoule opening device of this invention are set forth. It is to be understood that by providing such examples, the scope of the invention is in no way limited. The housing typically is 6 inches (152.4 mm) high, 1.875 inch (22.2 mm) in total width and is 2.125 inches (53.98 mm) deep across side walls 12. Projection 24 typically extends 0.125 inch (3.18 mm) outwardly from front wall 14 at a preferred angle of 30°, and has a total length of approximately 0.375 inch (9.53 mm). Hood 40 typically extends 0.625 inch (15.88 mm) outwardly from front wall 14 and has a width equal to that of top wall 18. Opening 22 typically has dimensions of 0.625 inch (15.88 mm) wide by 0.8125 inch (20.64 mm) high, while shoulders 26 are spaced 0.3125 inch (7.94 mm) apart.

In view of the above description, it is likely that modifications and improvements will occur to those skilled in the art which are within the scope of this invention.

What is claimed is:

1. An ampoule opener for severing the ampoule tip from an ampoule body at a narrowed neck disposed therebetween to open the ampoule, said ampoule opener comprising:

a housing;

a front face disposed on said housing and having a primary opening therein, said opening being of sufficient size to permit ampoule tips of several different diameters to pass therethrough;

a projection extending outwardly from said front wall adjacent said primary opening on one side thereof and forming a support adapted to receive the neck portion of the ampoule, the ampoule being adapted to be pivoted thereabout;

an upper bearing surface formed on interior portions of said housing adjacent said projection, said bearing surface being adapted to resist motion of said ampoule tip pressed thereagainst as force is applied to a lower portion of said ampoule body to pivot said ampoule neck about said projection to sever said ampoule tip from said ampoule body at its neck, said bearing surface being inclined downwardly toward said opening; and means disposed within the housing for collecting severed container tips.

2. The ampoule opener recited in either claim 1 and further comprising a hood extending outwardly from said front wall and surrounding a portion of said opening on a side of said opening opposite said projection.

3. The ampoule opener recited in claim 1 and further comprising a plurality of secondary openings in a wall of said housing adapted for receiving ampoule tips of varying sizes.

4. The ampoule opener recited in claim 1 wherein said projection extends at an angle of approximately 30° for a distance in the range of 0.125 inch.

5. The ampoule opener recited in claim 1 wherein said bearing surface has an angle of approximately 6° with respect to the horizontal.

6. An ampoule opener according to claim 1 comprising:

means on a wall of the housing for attaching the housing to a supporting surface.

* * * * *